US008884517B1

(12) United States Patent
Shum et al.

(10) Patent No.: US 8,884,517 B1
(45) Date of Patent: Nov. 11, 2014

(54) ILLUMINATION SOURCES WITH THERMALLY-ISOLATED ELECTRONICS

(75) Inventors: Frank Tin Chung Shum, Sunnyvale, CA (US); Frank M. Steranka, San Jose, CA (US); Michael R. Krames, Los Altos, CA (US)

(73) Assignee: Soraa, Inc., Fremont, CA (US)

( * ) Notice: Subject to any disclaimer, the term of this patent is extended or adjusted under 35 U.S.C. 154(b) by 114 days.

(21) Appl. No.: 13/274,489

(22) Filed: Oct. 17, 2011

(51) Int. Cl.
*H01K 1/62* (2006.01)
*H01J 9/24* (2006.01)

(52) U.S. Cl.
USPC ..... 315/32; 315/31

(58) Field of Classification Search
USPC ..... 315/32–38
See application file for complete search history.

(56) References Cited

U.S. PATENT DOCUMENTS

| | | | | |
|---|---|---|---|---|
| 5,764,674 | A | 6/1998 | Hibbs-Brenner et al. | |
| 6,204,602 | B1 * | 3/2001 | Yang et al. | 315/58 |
| 6,501,154 | B2 | 12/2002 | Morita et al. | |
| D471,881 | S | 3/2003 | Hegde | |
| 6,787,999 | B2 | 9/2004 | Stimac et al. | |
| 6,853,010 | B2 | 2/2005 | Slater et al. | |
| 6,964,877 | B2 | 11/2005 | Chen et al. | |
| 7,053,413 | B2 | 5/2006 | D'Evelyn et al. | |
| 7,148,515 | B1 | 12/2006 | Huang et al. | |
| 7,220,324 | B2 | 5/2007 | Baker et al. | |
| D545,457 | S | 6/2007 | Chen | |
| 7,252,408 | B2 | 8/2007 | Mazzochette | |
| 7,253,446 | B2 | 8/2007 | Sakuma et al. | |
| 7,311,417 | B1 | 12/2007 | Lemke | |
| 7,338,828 | B2 | 3/2008 | Imer et al. | |
| 7,344,279 | B2 | 3/2008 | Mueller et al. | |
| D581,583 | S | 11/2008 | Peng | |
| 7,488,097 | B2 | 2/2009 | Reisenauer et al. | |
| 7,506,998 | B2 | 3/2009 | Ansems et al. | |
| D592,613 | S | 5/2009 | Plonski et al. | |
| 7,550,305 | B2 | 6/2009 | Yamagata et al. | |
| 7,637,635 | B2 | 12/2009 | Xiao et al. | |
| 7,658,528 | B2 | 2/2010 | Hoelen et al. | |

(Continued)

FOREIGN PATENT DOCUMENTS

| | | |
|---|---|---|
| CN | 2826150 Y | 10/2006 |
| CN | 2009-75612 | 11/2007 |

(Continued)

OTHER PUBLICATIONS

Thermal Properties of Plastic Materials, Aug. 21, 2010.*

(Continued)

*Primary Examiner* — Tung X Le
*Assistant Examiner* — Jonathan Cooper
(74) *Attorney, Agent, or Firm* — Kilpatrick Townsend & Stockton LLP

(57) ABSTRACT

An lighting source includes a driver for outputting electrical power in response to external electrical power, wherein the driver generates heat in response thereto, a lamp coupled to the driver, for outputting light in response to the electrical power, wherein the lamp generates heat in response thereto, a first heat sink physically coupled to the driver for receiving and dissipating heat there from, a second heat sink physically coupled to the light for receiving heat and dissipating heat there from, and an insulating portion disposed between the first heat sink and the second heat sink, wherein the insulating portion is configured to inhibit heat from the lamp from being transferred to the driver.

22 Claims, 13 Drawing Sheets

(56) References Cited

U.S. PATENT DOCUMENTS

| | | | | |
|---|---|---|---|---|
| 7,663,229 | B2 | 2/2010 | Lu et al. | |
| 7,674,015 | B2 | 3/2010 | Chien | |
| D618,634 | S | 6/2010 | Lin et al. | |
| 7,744,259 | B2 | 6/2010 | Walczak et al. | |
| D619,551 | S | 7/2010 | Lin et al. | |
| 7,748,870 | B2 | 7/2010 | Chang et al. | |
| 7,824,075 | B2 | 11/2010 | Maxik | |
| 7,889,421 | B2 | 2/2011 | Narendran et al. | |
| 7,972,040 | B2 | 7/2011 | Li et al. | |
| 7,993,031 | B2 | 8/2011 | Grajcar | |
| D652,564 | S | 1/2012 | Maxik | |
| 8,153,475 | B1 | 4/2012 | Shum et al. | |
| D662,899 | S | 7/2012 | Shum et al. | |
| D662,900 | S | 7/2012 | Shum et al. | |
| 8,227,962 | B1 * | 7/2012 | Su | 313/46 |
| 8,272,762 | B2 | 9/2012 | Maxik et al. | |
| 8,324,835 | B2 | 12/2012 | Shum et al. | |
| D674,960 | S | 1/2013 | Chen et al. | |
| 8,390,207 | B2 | 3/2013 | Dowling et al. | |
| 8,405,947 | B1 * | 3/2013 | Green et al. | 361/103 |
| 8,414,151 | B2 | 4/2013 | Allen et al. | |
| 8,525,396 | B2 | 9/2013 | Shum et al. | |
| D694,722 | S | 12/2013 | Shum et al. | |
| 8,618,742 | B2 | 12/2013 | Shum et al. | |
| 8,643,257 | B2 | 2/2014 | Shum et al. | |
| 2001/0021073 | A1 | 9/2001 | Leggo et al. | |
| 2003/0039122 | A1 | 2/2003 | Cao | |
| 2003/0058650 | A1 | 3/2003 | Shih | |
| 2004/0222427 | A1 | 11/2004 | Hsiung | |
| 2004/0264195 | A1 | 12/2004 | Chang et al. | |
| 2005/0174780 | A1 | 8/2005 | Park | |
| 2005/0214992 | A1 | 9/2005 | Chakraborty et al. | |
| 2006/0065900 | A1 | 3/2006 | Hsieh et al. | |
| 2006/0152795 | A1 | 7/2006 | Yang | |
| 2006/0208262 | A1 | 9/2006 | Sakuma et al. | |
| 2006/0240585 | A1 | 10/2006 | Epler et al. | |
| 2006/0262545 | A1 | 11/2006 | Piepgras et al. | |
| 2006/0274529 | A1 | 12/2006 | Cao | |
| 2007/0007898 | A1 | 1/2007 | Bruning | |
| 2007/0284564 | A1 | 12/2007 | Biwa et al. | |
| 2008/0049399 | A1 | 2/2008 | Lu et al. | |
| 2008/0080137 | A1 | 4/2008 | Otsuki et al. | |
| 2008/0123341 | A1 | 5/2008 | Chiu | |
| 2008/0142781 | A1 | 6/2008 | Lee | |
| 2008/0158887 | A1 | 7/2008 | Zhu et al. | |
| 2008/0164489 | A1 | 7/2008 | Schmidt et al. | |
| 2008/0266866 | A1 | 10/2008 | Tsai | |
| 2008/0315228 | A1 | 12/2008 | Krames et al. | |
| 2009/0072252 | A1 | 3/2009 | Son et al. | |
| 2009/0134421 | A1 | 5/2009 | Negley | |
| 2009/0154166 | A1 | 6/2009 | Zhang et al. | |
| 2009/0161356 | A1 | 6/2009 | Negley et al. | |
| 2009/0173958 | A1 | 7/2009 | Chakraborty | |
| 2009/0175043 | A1 | 7/2009 | Frick | |
| 2009/0195186 | A1 | 8/2009 | Guest et al. | |
| 2009/0237940 | A1 | 9/2009 | Wu et al. | |
| 2009/0244899 | A1 | 10/2009 | Chyn | |
| 2009/0315965 | A1 | 12/2009 | Yamagata et al. | |
| 2010/0003492 | A1 | 1/2010 | D'Evelyn | |
| 2010/0025656 | A1 | 2/2010 | Raring et al. | |
| 2010/0060130 | A1 | 3/2010 | Li et al. | |
| 2010/0061076 | A1 | 3/2010 | Mandy et al. | |
| 2010/0091487 | A1 | 4/2010 | Shin | |
| 2010/0148145 | A1 | 6/2010 | Ishibashi et al. | |
| 2010/0207502 | A1 | 8/2010 | Cao et al. | |
| 2010/0207534 | A1 | 8/2010 | Dowling et al. | |
| 2010/0244648 | A1 | 9/2010 | Yoo | |
| 2010/0264799 | A1 | 10/2010 | Liu et al. | |
| 2010/0277068 | A1 | 11/2010 | Broitzman | |
| 2010/0290229 | A1 | 11/2010 | Meyer, Sr. et al. | |
| 2010/0320499 | A1 | 12/2010 | Catalano et al. | |
| 2011/0032708 | A1 | 2/2011 | Johnston et al. | |
| 2011/0056429 | A1 | 3/2011 | Raring et al. | |
| 2011/0095686 | A1 | 4/2011 | Falicoff et al. | |
| 2011/0140150 | A1 | 6/2011 | Shum | |
| 2011/0140586 | A1 | 6/2011 | Wang | |
| 2011/0169406 | A1 * | 7/2011 | Weekamp et al. | 315/32 |
| 2011/0175510 | A1 | 7/2011 | Rains, Jr. et al. | |
| 2011/0175528 | A1 | 7/2011 | Rains, Jr. et al. | |
| 2011/0182056 | A1 | 7/2011 | Trottier et al. | |
| 2011/0182065 | A1 | 7/2011 | Negley et al. | |
| 2011/0186874 | A1 | 8/2011 | Shum | |
| 2011/0186887 | A1 | 8/2011 | Trottier et al. | |
| 2011/0198979 | A1 | 8/2011 | Shum et al. | |
| 2011/0204763 | A1 | 8/2011 | Shum et al. | |
| 2011/0204779 | A1 | 8/2011 | Shum et al. | |
| 2011/0204780 | A1 | 8/2011 | Shum et al. | |
| 2011/0215348 | A1 | 9/2011 | Trottier et al. | |
| 2011/0242823 | A1 | 10/2011 | Tracy et al. | |
| 2011/0309734 | A1 | 12/2011 | Lin et al. | |
| 2012/0161626 | A1 | 6/2012 | van de Ven et al. | |
| 2012/0187830 | A1 | 7/2012 | Shum et al. | |
| 2012/0293062 | A1 | 11/2012 | Pickard | |
| 2013/0058099 | A1 | 3/2013 | Shum et al. | |
| 2013/0322089 | A1 | 12/2013 | Martis et al. | |
| 2013/0343062 | A1 | 12/2013 | Shum et al. | |
| 2014/0091697 | A1 | 4/2014 | Shum | |
| 2014/0146545 | A1 | 5/2014 | Shum et al. | |

FOREIGN PATENT DOCUMENTS

| | | |
|---|---|---|
| CN | 101608746 | 8/2011 |
| CN | 102149960 | 8/2011 |
| CN | 203099372 U | 7/2013 |
| JP | 2000-517465 | 12/2000 |
| JP | 2011-501351 | 1/2011 |
| WO | WO 2009/048956 | 3/2009 |
| WO | WO 2009/156969 | 12/2009 |
| WO | WO 2011/054716 | 5/2011 |

OTHER PUBLICATIONS

USPTO Notice of Allowance for U.S. Appl. No. 29/399,523 dated Mar. 5, 2012.

USPTO Notice of Allowance for U.S. Appl. No. 29/399,524 dated Mar. 2, 2012.

Haskell et al., 'Defect Reduction in (1100) m-plane gallium nitride via lateral epitaxial overgrowth by hydride vapor phase epitaxy', Applied Physics Letters 86, 111917 (2005), pp. 1-3.

USPTO Office Action for U.S. Appl. No. 12/785,953 dated Apr. 12, 2012.

USPTO Office Action for U.S. Appl. No. 13/025,791 dated Nov. 25, 2011.

USPTO Office Action for U.S. Appl. No. 13/025,833 dated Dec. 14, 2011.

USPTO Office Action for U.S. Appl. No. 13/025,860 dated Dec. 30, 2011.

USPTO Notice of Allowance for U.S. Appl. No. 13/025,860 dated Jun. 8, 2012.

USPTO Office Action for U.S. Appl. No. 13/025,833 dated Jul. 12, 2012.

USPTO Office Action for U.S. Appl. No. 13/025,791 dated Feb. 20, 2013.

USPTO Office Action for U.S. Appl. No. 13/025,849 dated Mar. 15, 2013.

U.S. Appl. No. 13/135,087, filed Jun. 23, 2011. Trottier et al., unpublished.

U.S. Appl. No. 12/914,789, filed Oct. 28, 2010, Shum, unpublished.

U.S. Appl. No. 12/858,379, filed Aug. 17, 2010, Shum, unpublished.

U.S. Appl. No. 61/257,303, filed Nov. 2, 2009, Shum, unpublished.

U.S. Appl. No. 61/256,934, filed Oct. 30, 2009, Shum, unpublished.

U.S. Appl. No. 61/241,457, filed Sep. 11, 2009, Shum, unpublished.

U.S. Appl. No. 61/241,455, filed Sep. 11, 2009, Shum, unpublished.

USPTO Notice of Allowance for U.S. Appl. No. 13/025,849 dated Sep. 16, 2013, 10 pages.

USPTO Office Action for U.S. Appl. No. 13/535,142 dated Aug. 1, 2013, 14 pages.

USPTO Notice of Allowance for U.S. Appl. No. 29/423,725 dated Jul. 19, 2013, 11 pages.

(56) References Cited

OTHER PUBLICATIONS

Nakamura, 'Candela-Class High-Brightness InGaN/AlGaN Double-Heterostructure Blue-Light-Emitting Diodes', Applied Physics Letters, vol. 64, No. 13, Mar. 1994, pp. 1687-1689.
Communication from the Japanese Patent Office re 2012191931, dated Oct. 11, 2013.
USPTO Notice of Allowance for U.S. Appl. No. 13/025,833 dated Oct. 11, 2013 (11 pages).
USPTO Office Action for U.S. Appl. No. 13/269,193 dated Oct. 3, 2013 (12 pages).
USPTO Office Action for U.S. Appl. No. 13/480,767 dated Oct. 25, 2013 (28 pages).
USPTO Office Action for U.S. Appl. No. 13/535,142 dated Nov. 14, 2013 (23 pages).
USPTO Office Action for U.S. Appl. No. 13/959,422 dated Oct. 8, 2013 (10 pages).
USPTO Notice of Allowance for U.S. Appl. No. 13/269,193 dated Mar. 31, 2014 (8 pages).
USPTO Office Action for U.S. Appl. No. 13/480,767 dated Apr. 29, 2014 (21 pages).
USPTO Office Action for U.S. Appl. No. 13/535,142 dated Feb. 25, 2014 (23 pages).
International Preliminary Report & Written Opinion of PCT Application No. PCT/US2011/060030 dated Mar. 21, 2012, 11 pgs. total.
'CFL Ballast IC Drive LED', www.placardshop.com, Blog, May 22, 2012, 3 pgs.
Rausch, 'Use a CFL ballast to drive LEDs', EDN Network, 2007, pp. 1-2.
USPTO Office Action for U.S. Appl. No. 12/785,953 dated Jan. 11, 2013.
USPTO Notice of Allowance for U.S. Appl. No. 13/025,791 dated Jun. 17, 2013.
USPTO Office Action for U.S. Appl. No. 13/025,833 dated Apr. 26, 2013.

* cited by examiner

ILLUMINATION SOURCES WITH THERMALLY-ISOLATED ELECTRONICS

BACKGROUND OF THE INVENTION

The present invention relates to lighting. More specifically, the present invention relates to high efficiency lighting sources.

The era of the Edison vacuum light bulb will be coming to an end soon. In many countries and in many states, common incandescent bulbs are becoming illegal, and more efficient lighting sources are being mandated. Some of the alternative light sources currently include fluorescent tubes, halogen, and light emitting diodes (LEDs). Despite the availability and improved efficiencies of these other options, many people have still been reluctant to switch to these alternative light sources.

The inventors of the present believe that there are several key reasons why consumers have been slow to adopt the newer technologies. One such reason is the use of toxic substances in the lighting sources. As an example, fluorescent lighting sources typically rely upon mercury in a vapor form to produce light. Because the mercury vapor is considered a hazardous material, spent lamps cannot simply be disposed of at the curbside but must be transported to designated hazardous waste disposal sites. Additionally, some fluorescent tube manufacturers go so far as to instruct the consumer to avoid using the bulb in more sensitive areas of the house such as bedrooms, kitchens, and the like.

The inventors also believe that another reason for the slow adoption of alternative lighting sources is the low performance compared to the incandescent light bulb. As an example, fluorescent lighting sources often rely upon a separate starter or ballast mechanism to initiate the illumination. Because of this, fluorescent lights sometimes do not turn on "instantaneously" as consumers expect and demand. Further, fluorescent lights typically do not immediately provide light at full brightness, but typically ramp up to full brightness within an amount of time (e.g. 30 seconds). Further, most fluorescent lights are fragile, are not capable of dimming, have ballast transformers that can emit annoying audible noise, and can fail in a shortened period of time if cycled on and off frequently. Because of this, fluorescent lights do not have the performance consumers require.

Another type of alternative lighting source more recently introduced relies on the use of light emitting diodes (LEDs). LEDs have advantages over fluorescent lights including the robustness and reliability inherent in solid state devices, the lack of toxic chemicals that can be released during accidental breakage or disposal, instant-on capabilities, dimmability, and the lack of audible noise. The inventors of the present invention believe, however, that current LED lighting sources themselves have significant drawbacks that cause consumers to be reluctant to using them.

A key drawback with current LED lighting sources is that the light output (e.g. lumens) is relatively low. Although current LED lighting sources draw a significantly lower amount of power than their incandescent equivalents (e.g. 5-10 watts v. 50 watts), they are believe to be far too dim to be used as primary lighting sources. As an example, a typical 5 watt LED lamp in the MR16 form factor may provide 200-300 lumens, whereas a typical 50 watt incandescent bulb in the same form factor may provide 700-1000 lumens. As a result, current LEDs are often used only for exterior accent lighting, closets, basements, sheds or other small spaces.

Another drawback with current LED lighting sources includes that the upfront cost of the LED is often shockingly high to consumers. For example, for floodlights, a current 30 watt equivalent LED bulb may retail for over $60, whereas a typical incandescent floodlight may retail for $12. Although the consumer may rationally "make up the difference" over the lifetime of the LED by the LED consuming less power, the inventors believe the significantly higher prices greatly suppress consumer demand. Because of this, current LED lighting sources do not have the price or performance that consumers expect and demand.

Additional drawbacks with current LED lighting sources includes they have many parts and are labor intensive to produce. As merely an example, one manufacturer of an MR16 LED lighting source utilizes over 14 components (excluding electronic chips), and another manufacturer of an MR 16 LED lighting source utilizes over 60 components. The inventors of the present invention believe that these manufacturing and testing processes are more complicated and more time consuming, compared to manufacturing and testing of a LED device with fewer parts and a more modular manufacturing process.

Additional drawbacks with current LED lighting sources, are that the output performance is limited by heat sink volume. More specifically, the inventors believe for replacement LED light sources, such as MR16 light sources, current heat sinks are incapable of dissipating very much heat generated by the LEDs under natural convection. In many applications, the LED lamps are placed into an enclosure such as a recessed ceiling that already have an ambient air temperatures to over 50 degrees C. At such temperatures the emissivity of surfaces play only a small roll of dissipating the heat. Further, because conventional electronic assembly techniques and LED reliability factors limit PCB board temperatures to about 85 degrees C., the power output of the LEDs is also greatly constrained. At higher temperatures, the inventors have discovered that radiation plays much more important role; thus high emissivity for a heat sink is desirable.

Traditionally, light output from LED lighting sources have been increased by simply increasing the number of LEDs, which has lead to increased device costs, and increased device size. Additionally, such lights have had limited beam angles and limited outputs.

Accordingly, what is desired is a highly efficient lighting source without the drawbacks described above.

BRIEF SUMMARY OF THE INVENTION

This invention relates to high efficient lighting sources. More specifically, the invention relates to a LED lighting source and methods of manufacturing thereof. Some general goals include, to increase light output without increasing device cost or device size, to enable coverage of many beam angles, and to provide a high reliability product for long life (ROI).

Embodiments of the invention include a modular lighting source. More specifically, various embodiments include an MR16 form factor light source. A lighting module includes from 20 to 110 LEDs arrayed in series upon a thermally conductive substrate (e.g. silicon substrate). The silicon substrate is soldered to a flexible printed circuit substrate (FPC) having a pair of input power connectors on a first surface. The silicon substrate is physically bonded to an MR16 form factor heat sink via a thermal epoxy on a second surface. A driving module includes a high-temperature operating driving circuit soldered to a rigid printed circuit board or a flexible printed circuit substrate. The driving circuit and FPC are encased in a thermally conductive plug base that is compatible with an MR16 plug, forming the base assembly module. A potting compound facilitating heat transfer from the driving circuit to the thermally conductive plug case is typically used. The driving circuits are coupled to input power contacts (e.g. 12, 24, 120, 220 volt AC) and coupled to output power connectors (e.g. 40 VAC, 120 VAC, etc.) The base assembly module is inserted into and secured within an interior channel of the MR16 form factor heat sink. The input power connectors are coupled to the output power connectors. A lens is then secured to the heat sink.

In one embodiment, the driving module transforms the input power from 12 AC volts to a higher DC voltage, such as 40 volts to 120 Volts. In turn, the driving module drives the lighting module with the higher voltage, and the lighting module emits the light. The light is conditioned with the lens to the desired type of lighting, e.g. spot, flood, etc. In operation, the driving module and the lighting module produce heat that is dissipated by the MR16 form factor heat sink. At steady state, these modules usually operate in the range of approximately 75° C. to 130° C.

The MR16 form factor heat sink facilitates the dissipation of heat. The heat sink includes an inner core that has a diameter less than half the outer diameter of the heat sink. In various embodiments, the inner core is less than one third, one fourth, and one fifth the outer diameter. The silicon substrate of the LEDs is directly bonded to the inner core region via the thermal epoxy.

In various embodiments, because the diameter of the inner core is much less than the outer diameter, a larger amount of heat dissipating fins can be provided. A number of heat dissipating fin configurations have been developed and studied by the inventors. Typical fin configurations include a number radiating fin "trunks" extending from the inner core. In some embodiments, the number of trunks range from 8 to 35. At the end of each trunk, two or more fin "branches" are provided having "U" branching shape. In various embodiments, at the end of each branch, two or more fin "sub-branches" are provided, also having a "U" branching shape. In various embodiments, the fin thickness of the trunk may be thicker than the branches, which in turn may be thicker than the sub-branches, etc. The amount of heat flow from the inner core towards the outer diameter, airflow, and surface area are therefore engineered to increase heat dissipating capability.

According to one aspect of the invention, an illumination source is provided. One device includes an electronic power portion configured to provide electrical power output in response to external electrical power input, wherein the electronic power portion generates heat in response to the external electrical power input, and a light producing portion coupled to the electronic driving portion, wherein the light generating portion is configured to output light energy in response to the electrical power output, wherein the light producing portion generates heat in response to the electrical power output. An apparatus includes a first heat dissipation portion physically coupled to the electronic power portion, wherein the first heat dissipation portion is configured to receive the heat from the electronic power portion and configured to dissipate the heat from the electronic power portion, and a second heat dissipation portion physically coupled to the light producing portion, wherein the second heat dissipation portion is configured to receive heat from the light producing portion and configured to dissipate the heat from the light producing portion. A system includes an insulating portion physically disposed between the first heat dissipation portion and the second heat dissipation portion, wherein the insulator portion is configured to inhibit the heat from the light producing portion from being transferred to the electronic power portion.

According to another aspect of the invention, a method for assembling an illumination source is disclosed. One technique includes providing an electronic power portion configured to provide electrical power output in response to external electrical power input, wherein the electronic power portion generates heat in response to the external electrical power input, providing a first heat dissipation portion, wherein the first heat dissipation portion is configured to receive the heat from the electronic power portion and configured to dissipate the heat from the electronic power portion, and physically coupling the electronic power portion to the first heat dissipation portion to form a driving portion. One process includes providing a light producing portion, wherein the light generating portion is configured to output light energy in response to the electrical power output, wherein the light producing portion generates heat in response to the electrical power output, providing a second heat dissipation portion, wherein the second heat dissipation portion is configured to receive heat from the light producing portion and configured to dissipate the heat from the light producing portion, and physically coupling the light producing portion to the second heat dissipation portion to form a lighting portion. A method includes providing an insulating portion, and physically coupling the driving portion to the lighting portion via the insulating portion, wherein the insulator portion is configured to inhibit the heat from the lighting portion from being transferred to the driving portion.

Other aspects of various embodiments include: simplified construction facilitating high volume manufacturing, flex interconnects to eliminate hand wiring, modular subassembly construction to enable parallel processing. Other features include thermal management aspects: fin branching algorithm, reduced cross section central core, airflow behind lens, single thermal interface, direct die attach, flex printed circuits in base, base contour to minimize potting material, recessed front, ensured airflow with coverage; low-cost manufacturing: flexible printed circuit interconnect (main and interposer), separable driver module, flex circuit light chip interposer, redundant latching and bonding features, and the like. Other aspects include: high temperature operation enabling a densely packed LED array, higher component reliability, high heat dissipation, maximum surface area, maximum airflow, minimum thermal interface losses, minimum length thermal paths within the electronics module, and the like. Advantage with embodiments of the present invention include operating a LED light source reliably at high temperatures, allowing the concentration of a large number of LEDs in a small space while simultaneously operating them at higher power levels.

BRIEF DESCRIPTION OF THE DRAWINGS

To more fully understand the invention, reference is made to the accompanying drawings. Understanding that these drawings are not to be considered limitations in the scope of the invention, the presently described embodiments and the presently understood best mode of the invention are described with additional detail through use of the accompanying drawings in which.

DETAILED DESCRIPTION OF THE INVENTION

Figure 1A:
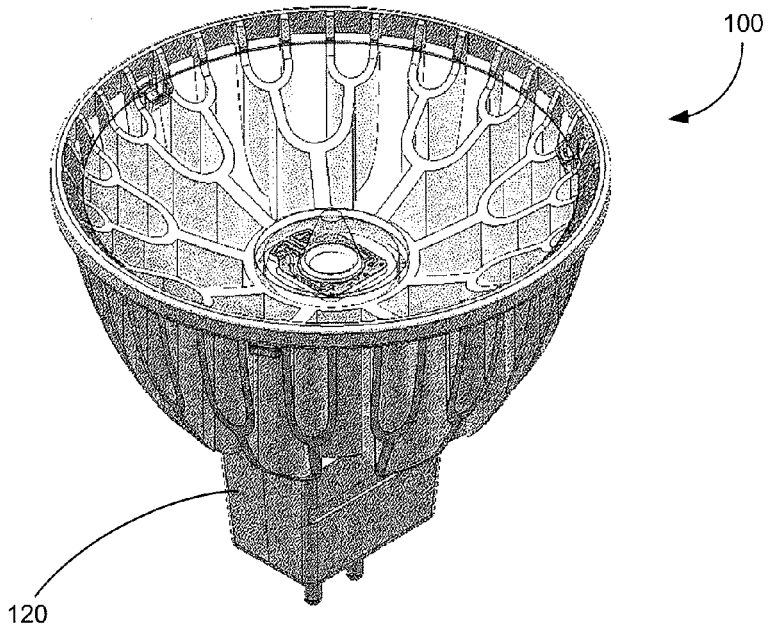
FIGS. 1A-B illustrate various embodiments of the present invention.
Figure 1B:
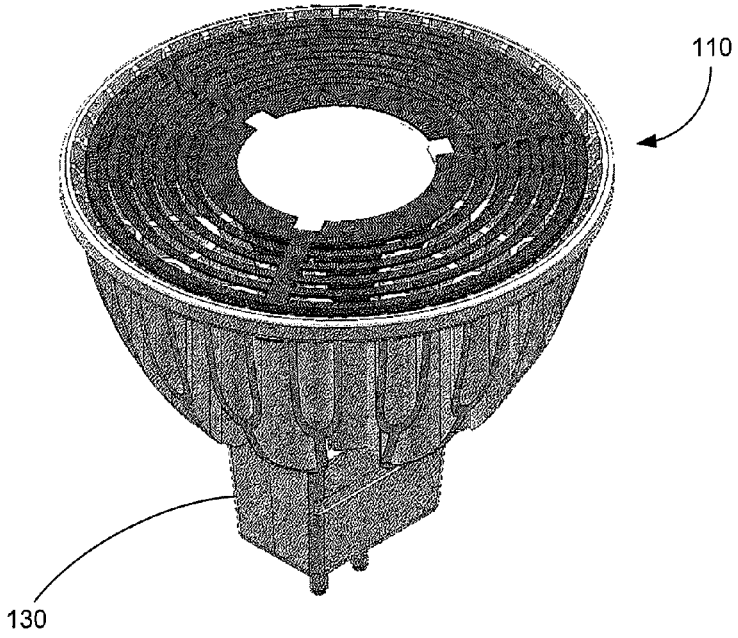

FIGS. 1A-B illustrate various embodiments of the present invention. More specifically, FIGS. 1A-B illustrate embodiments of MR-16 form factor compatible LED lighting sources 100 and 110 having GU 5.3 form factor compatible bases 120 and 130. Such MR-16 lighting sources typically operate upon 12 volts, alternating current (e.g. VAC). In the examples illustrated, LED lighting source 100 is configured to provide a spot light having a 10 degree beam size and LED lighting source 110 is configured to provide a flood light having a 25 or 40 degree beam size.

In various embodiments, an LED assembly described in the pending patent applications described above, and variations thereof, may be used within LED lighting sources 100 and 110. Theses LED assemblies are currently under development by the assignee of the present patent application. In various embodiments, LED lighting source 100 may provide a peak output brightness from approximately 7600 to 8600 candelas (with approximately 360 to 400 lumens), LED lighting source 110 may provide a peak output brightness of approximately 1050 to 1400 candelas for a 40 degree flood light (with approximately 510 to 650 lumens), and approximately 2300 to 2500 candelas for a 25 degree flood light (with approximately 620 to 670 lumens). Various embodiments of the present invention therefore are believed to have achieve the same brightness as conventional halogen bulb MR-16 lights.

Figure 2A:
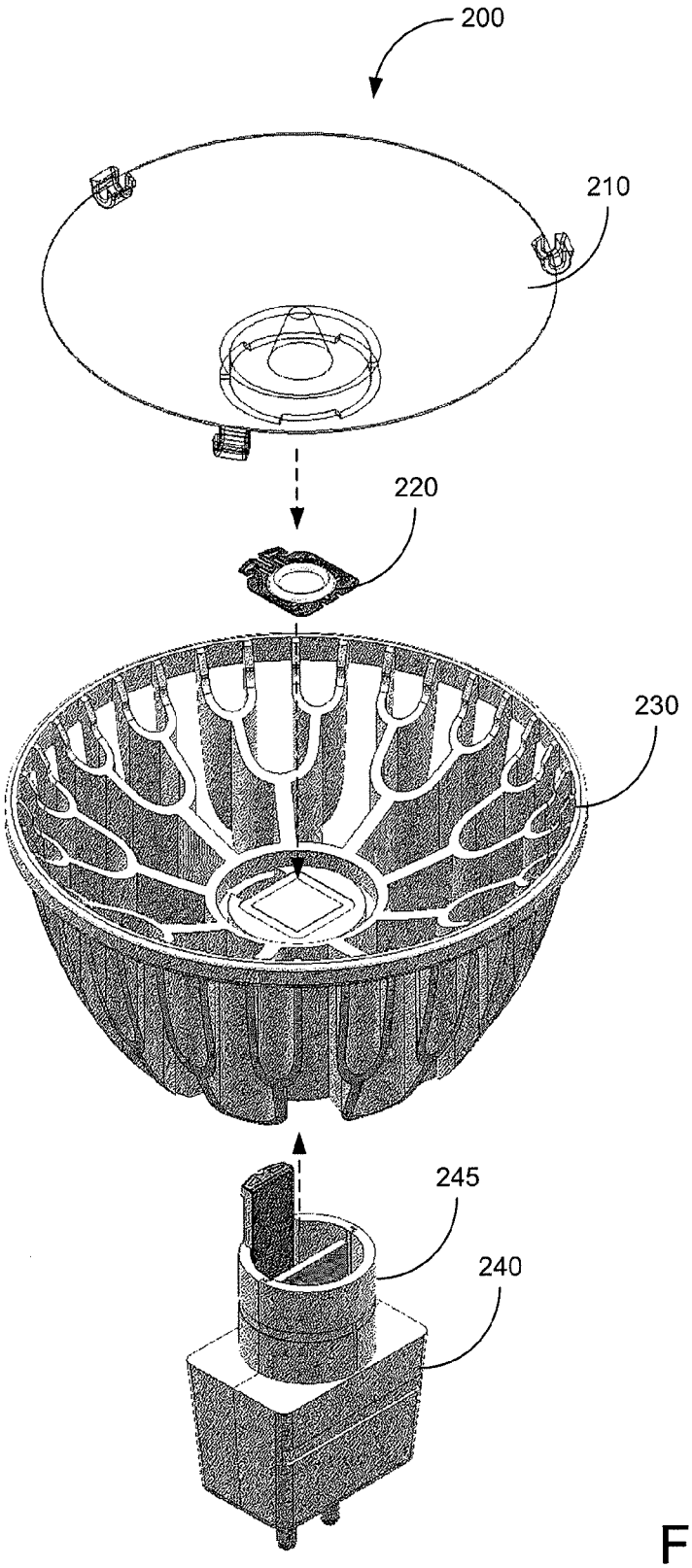
FIGS. 2A-B illustrates modular diagrams according to various embodiments of the present invention.
Figure 2B:
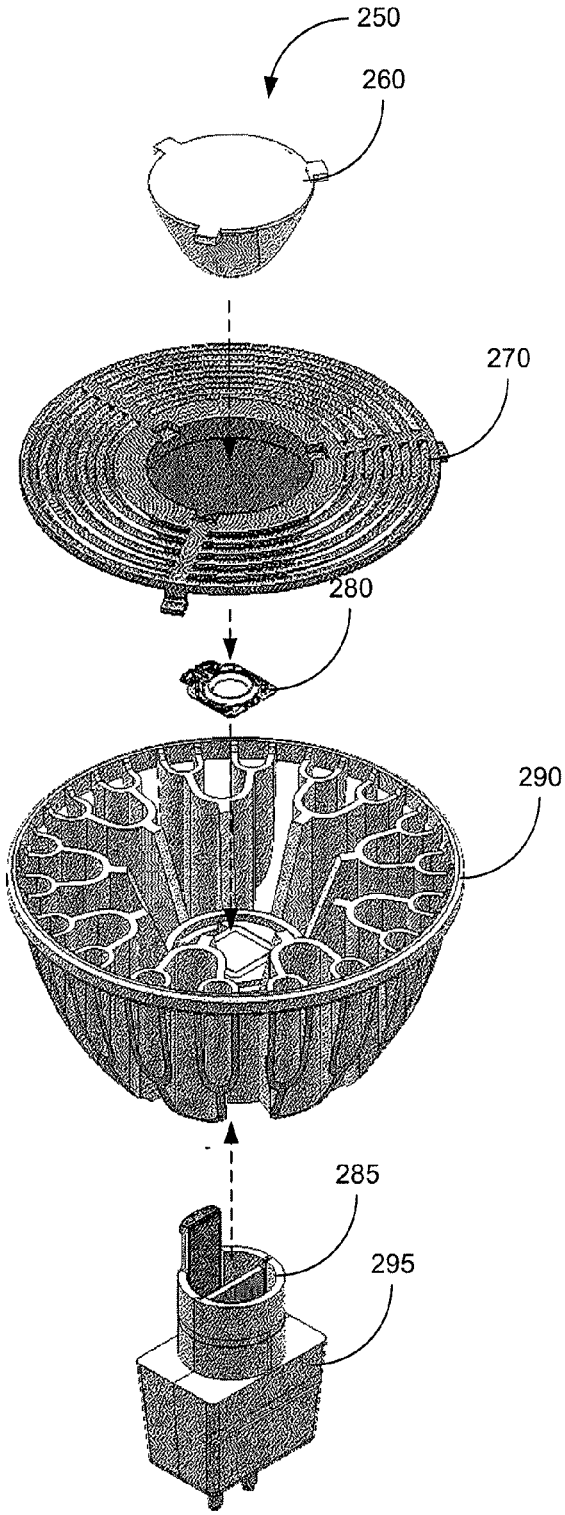

FIGS. 2A-B illustrates modular diagrams according to various embodiments of the present invention. More specifically, FIG. 2A illustrates a modular diagram of a spot light 200, and FIG. 2B illustrates a modular diagram of a flood light 250.

As can be seen in FIG. 2A in various embodiments, spotlight 200 includes a lens 210, an LED assembly/module 220, a heat sink 230, and a base assembly/module 240. Further, as can be seen in FIG. 2B, in various embodiments, flood light 250 includes a lens 260, a lens holder 270, an LED assembly/module 280, a heat sink 290, and a base assembly/module 295.

As will be discussed further below, in various embodiments, the modular approach to assembling spotlight 200 or floodlight 250 are believed to reduce the manufacturing complexity, reduce manufacturing costs, and increase the reliability of such lights.

Lens 210 and/or lens 260 may be formed from a UV and resistant transparent material, such as glass, polycarbonate material, or the like. Lens 210 and 26 also may be solid. In the case of lens 210, the solid material creates a folded light path such that light that is generated by the LED assembly 220 internally reflects within lens 210 more than one time prior to being output. Such a folded optic lens enables spotlight 200 to have a tighter columniation of light than is normally available from a conventional reflector of equivalent depth.

To increase durability of the lights, the transparent material should be operable at an elevated temperature (e.g. 120 degrees C.) for a prolonged period of time (e.g. hours). One material that may be used for lens 210 and/or lens 260 is known as Makrolon™ LED 2045 or LED 2245 polycarbonate available from Bayer Material Science AG. In other embodiments, other similar materials may also be used.

In FIG. 2A, lens 210 is secured to heat sink 230 via one or more clips integrally formed on the edge of lens 210. In addition, lens 210 may also be secured via an adhesive proximate to where LED assembly 220 is secured to heat sink 230. In FIG. 2B, lens 260 may be secured to a lens holder 270 via one or more tabs integrally formed on the edge of lens 260. In turn, lens holder 270 may be secured to heat sink 290 by one or more tabs integrally formed on the edge of lens holder 270, as illustrated. In various embodiments, lens holder 270 may be formed of plastic material that is preferably white colored to reflect backward scattered light back through the lens. Other similar heat resistant materials may also be used for lens holder 270.

The LED assembly 220 and LED assembly 280 may be of similar construction, and thus interchangeable during the manufacturing process. In other embodiments, LED assemblies may be binned based upon lumen per watt efficacy. For example, in some examples, a LED assembly having a lumen per watt (L/W) efficacy from 53 to 66 L/W may be binned for use for 40 degree flood lights, a LED assembly having an efficacy of approximately 60 L/W may be binned for use for spot lights, a LED assembly having an efficacy of approximately 63 to 67 L/W may be use for 25 degree flood lights, and the like. In other embodiments, other classification or categorization of LED assemblies on the basis of L/W efficacy may used for other target applications.

As is discussed below LED assembly 220 and LED assembly 280 typically include 36 LEDs arranged in series, in parallel series (e.g. three parallel strings of 12 LEDs in series), or the like. Further detail regarding such LED assemblies are provided in the patent applications incorporated by reference above.

The targeted power consumption for LED assemblies is less than 13 watts. This is much less than the typical power consumption of halogen based MR16 lights (50 watts). Accordingly, embodiments of the present invention are able to match the brightness or intensity of halogen based MR16 lights, but using less than 20% of the energy.

In some embodiments of the invention, LED assembly 220 is directly secured to heat sink 230 and LED assembly 280 is directly secured to heat sink 280. As will be discussed below, LED assemblies 220 and 280 typically includes a flat substrate such as silicon or the like. In various embodiments, it is contemplated that an operating temperature of LED assemblies 220 and 280 may be on the order of 125 to 140 degrees C. The silicon substrate is then secured to the heat sink using a high thermal conductivity epoxy (e.g. thermal conductivity ~96 W/m·k.). A thermoplastic/thermo set epoxy may be used such as TS-369, TS-3332-LD, or the like, available from Tanaka Kikinzoku Kogyo K.K. Other epoxies may also be used. In some embodiments, no screws are otherwise used to secure the LED assembly to the heat sink, however, screws or other fastening means may also be used in other embodiments.

Heat sinks 230 and 290 may be formed from a material having a low thermal resistance/high thermal conductivity. In some embodiments, heat sinks 230 and 290 may be formed from an anodized 6061-T6 aluminum alloy having a thermal conductivity k=167 W/m·k., and a thermal emissivity e=0.7. In other embodiments, other materials may be used such as 6063-T6 or 1050 aluminum alloy having a thermal conductivity k=225 W/mk and a thermal emissivity e=0.9. In other embodiments, still other alloys such AL 1100, or the like may be used. Additional coatings may also be added to increase thermal emissivity, for example, paint provided by ZYP Coatings, Inc. utilizing CR2O3 or CeO2 may provide a thermal emissivity e=0.9; coatings provided by Materials Technologies Corporation under the brand name Duracon™ may provide a thermal emissivity e>0.98; and the like.

In some example, at an ambient temperature of 50 degrees C., and in free natural convection heat sink 230 has been measured to have a thermal resistance of approximately 8.5 degrees C./Watt, and heat sink 290 has been measured to have a thermal resistance of approximately 7.5 degrees C./Watt. With further development and testing, it is believed that a thermal resistance of as little as 6.6 degrees C./Watt are achievable in other embodiments. In light of the present patent disclosure, it is believed that one of ordinary skill in the art will be able to envision other materials having different properties within embodiments of the present invention.

The base assemblies/modules 240 and 295 in FIGS. 2A-B provide a standard GU 5.3 physical and electronic interface to a light socket. As will be described in greater detail below, base modules 240 and 295 includes high temperature resistant electronic circuitry used to drive LED modules 220 and 280. In various embodiments, an input voltage of 12 VAC to the lamps is converted to 120 VAC, 40 VAC, or other voltage by the LED driving circuitry. The driving voltage may be set depending upon specific LED configuration (e.g. series, parallel/series, etc.) desired.

The shell of base assemblies 240 and 295 are typically formed from an aluminum alloy, and may formed from an alloy similar to that used for heat sink 230 and/or heat sink 290. In one example, an alloy such as AL 1100 may be used. In various embodiments, to facilitate a transfer of heat from the LED driving circuitry to the shells of the base assemblies, a compliant potting compound such as Omegabond® 200 available from Omega Engineering, Inc. or 50-1225 from Epoxies, Etc. may be used. In other embodiments, other types of heat transfer materials may be used.

A thermally insulating material, sleeve, compound, or the like may be disposed between surfaces 245 and 285 of the base assemblies 240 and 295 and interior cavities of heat sinks 230 and 290, respectively. The thermally insulating materials are provided to facilitate thermal isolation between base assemblies 240 and 295 from heat sinks 230 and 290, respectively. More specifically, the thermally barrier functions to keep a steady-state operating temperature of base assemblies 240 and 295 lower than a steady-state operating temperature of heat sinks 230 and 290, respectively. In one example, it is expected that the operating temperature of heat sink 230 or 290 may be on the order of 120 C, near LED modules 220 or 280, whereas the operating temperature of base assembly 240 or 295 may be on the order of 110 C, and less. In another example, the temperature difference may be on the order of 5 C or higher, 20 C or higher, or the like.

The inventors believe there are benefits to having the operating temperature of a base assembly be lower than the operating temperature of a LED module. One such benefit is that because the electronic circuits within the base assembly may be subject to a lower temperature, lower cost electronic components (with lower temperature ratings) may be used. Another benefit is that the reliability of such a lamp may be increased because the electronic circuits are subject to lower temperatures and will tend to have longer life spans. Yet another benefit is that such a lamp may be safer to use because less excess heat would be radiated to a lamp housing from the base assembly, compared to lamps without such an insulating layer.

In various embodiments, a thermally insulating material, sleeve, compound, or the like may be made of silicone, rubber, plastics, ceramic, and the like. In various embodiments, the thermal barrier may be a solid object, as illustrated in FIG. 8B, and in other embodiments, the thermal barrier may be a paste-like compound. In some embodiments, it is desired that a thermal conductivity is less than 2 watts/M*K, less than 1 watt/M*K, or the like.

Figure 3A:
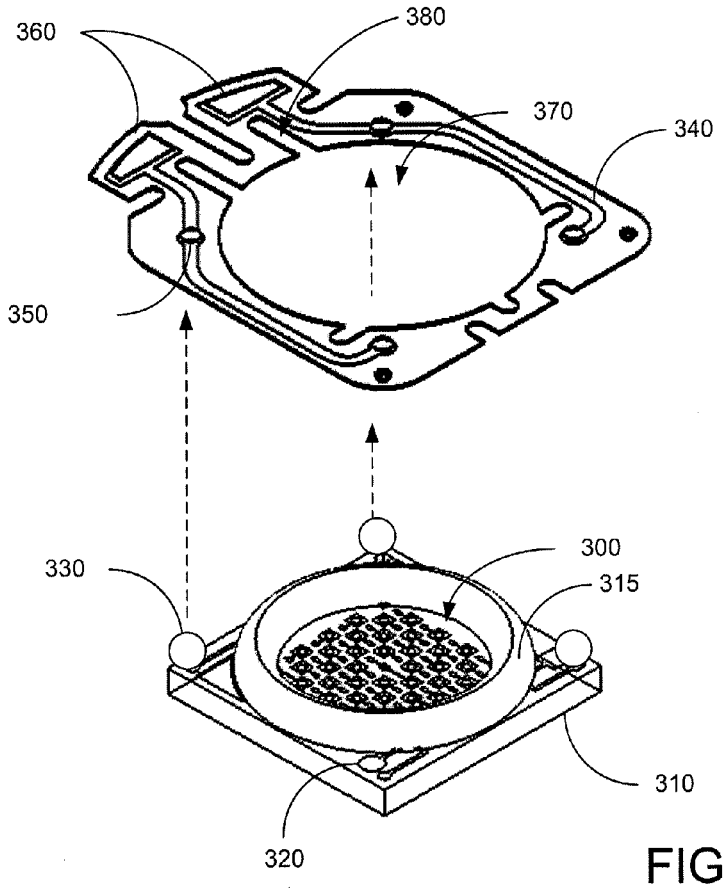
FIGS. 3A-B illustrate an embodiment of the present invention.
Figure 3B:
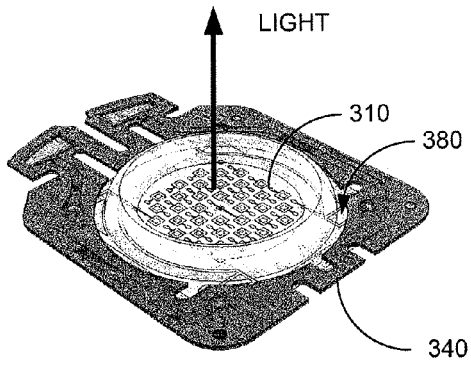

FIGS. 3A-B illustrate an embodiment of the present invention. More specifically, FIG. 3A illustrates an LED package subassembly (LED module) according to various embodiments. More specifically, a plurality of LEDs 300 are illustrated disposed upon a substrate 310. In some embodiments, it is contemplated that the plurality of LEDs 300 are connected in series and powered by a voltage source of approximately 120 volts AC (VAC). To enable a sufficient voltage drop (e.g. 3 to 4 volts) across each LED 300, in various embodiments 30 to 40 LEDs are contemplated to be used. In specific embodiments, 37 to 39 LEDs are coupled in series. In other embodiments, LEDs 300 are connected in parallel series and powered by a voltage source of approximately 40 VAC. For example, the plurality of LEDs 300 include 36 LEDs arranged in three groups each having 12 LEDs 300 coupled in series. Each group is thus coupled in parallel to the voltage source (40 VAC) provided by the LED driver circuitry, such that a sufficient voltage drop (e.g. 3 to 4 volts) is achieved across each LED 300. In other embodiments, other driving voltages are envisioned, and other arrangements of LEDs 300 are also envisioned.

IThe LEDs 300 are mounted upon a silicon substrate 310, or other thermally conductive substrate. In various embodiments, a thin electrically insulating layer and/or a reflective layer may separate LEDs 300 and the silicon substrate 310. Heat produced from LEDs 300 is typically transferred to silicon substrate 310 and to a heat sink via a thermally conductive epoxy, as discussed above.

The silicon substrate is approximately 5.7 mm×5.7 mm in size, and approximately 0.6 microns in depth. The dimensions may vary according to specific lighting requirement. For example, for lower brightness intensity, fewer LEDs may be mounted upon the substrate, accordingly the substrate may decrease in size. In other embodiments, other substrate materials may be used and other shapes and sizes may also be used.

As shown in FIG. 3A, a ring of silicone 315 is disposed around LEDs 300 to define a well-type structure. In various embodiments, a phosphorus bearing material is disposed within the well structure. In operation, LEDs 300 provide a blue-ish light output, a violet, or a UV light output. In turn, the phosphorous bearing material is excited by the blue/uv output light, and emits white light output. Further details of embodiments of plurality of LEDs 300 and substrate 310 are described in the co-pending application incorporated by reference and referred to above.

As illustrated in FIG. 3A, a number of bond pads 320 may be provided upon substrate 310 (e.g. 2 to 4). Then, a conventional solder layer (e.g. 96.5% tin and 5.5% gold) may be disposed upon silicon substrate 310, such that one or more solder balls 330 are formed thereon. In the embodiments illustrated in FIG. 3A, four bond pads 320 are provided, one at each corner, two for each power supply connection. In other embodiments, only two bond pads may be used, one for each AC power supply connection.

Illustrated in FIG. 3A is a flexible printed circuit (FPC) 340. In various embodiments, FPC 340 may include a flexible substrate material such as a polyimide, such as Kapton™ from DuPont, or the like. As illustrated, FPC 340 may have a series of bonding pads 350, for bonding to silicon substrate 310, and bonding pads 360, for coupling to the high supply voltage (e.g. 120 VAC, 40 VAC, etc). Additionally, in some embodiments, an opening 370 is provided, through which LEDs 300 will shine through.

Various shapes and sizes for FPC 340 are contemplated in various embodiments of the invention. For example, as illustrated in FIG. 3A, a series of cuts 380 may be made upon FPC 340 to reduce the effects of expansion and contraction of FPC 340 versus substrate 310. As another example, a different number of bonding pads 350 may be provided, such as two bonding pads. As merely another example, FPC 340 may be crescent shaped, and opening 370 may not be a through hole. In other embodiments, other shapes and sizes for FPC 340 are contemplated in light of the present patent disclosure.

In FIG. 3B, substrate 310 is bonded to FPC 340 via solder balls 330, in a conventional flip-chip type arrangement to the top surface of the silicon. By making the electrical connection at the top surface of the silicon, it is electrically isolated from the heat transfer surface of the silicon. This allows the entire bottom surface of the silicon to transfer heat to the heat sink. Additionally, this allows the LED to bonded directly to the heat sink to maximize heat transfer instead of a PCB material that typically inhibits heat transfer. As can be seen in this configuration, LEDs 300 are thus positioned to emit light through opening 370. Subsequently, a under fill operation is performed using a silicone compound, or the like to seal the space 380 between substrate 310 and FPC 340. The LED package sub assembly or module is thus assembled. In various embodiments, these LED modules may then be individually tested for proper operation.

As illustrated in FIG. 3B, the LED sub assembly/module is thus assembled. In various embodiments, these LED modules may then be individually tested for proper operation.

Figure 4A:
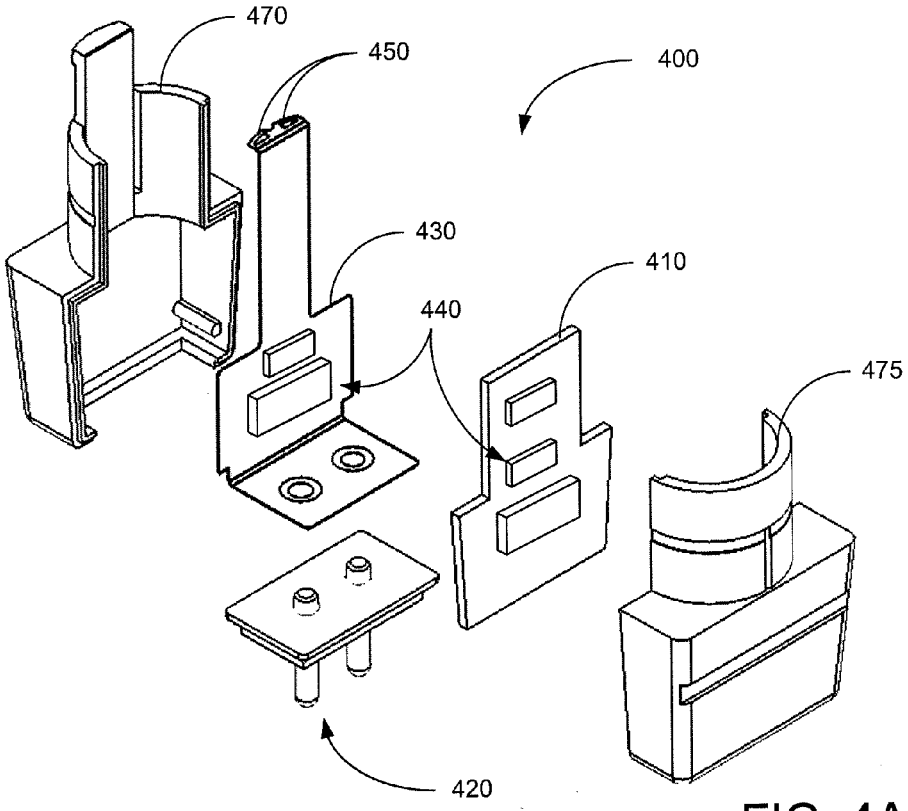
FIGS. 4A-C illustrate various embodiments of the present invention.
Figure 4B:
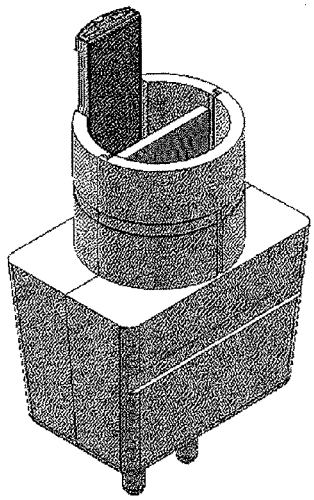

FIGS. 4A-B illustrate various embodiments of the present invention. More specifically, FIGS. 4A-B illustrate embodiments of a driver module according to various embodiments.

FIG. 4A illustrates embodiments of an LED driver circuit 400 for driving the LED module described above in FIGS. 3A-B. Physically, driver circuit 400 includes contacts 420, and a flexible printed circuit (FPC) 430 electrically coupled to circuit board 410. In various embodiments FPC 430 may be formed using a polyimide, such as Kapton™ as mentioned above. Further, in various embodiments, contacts 420 are conventional GU 5.3 compatible electrical contacts and provide driver circuit 400 an operating voltage (e.g. 12 VAC). In other embodiments, other base form factors for the electrical contacts, and other operating voltages are contemplated.

Figure 4C:
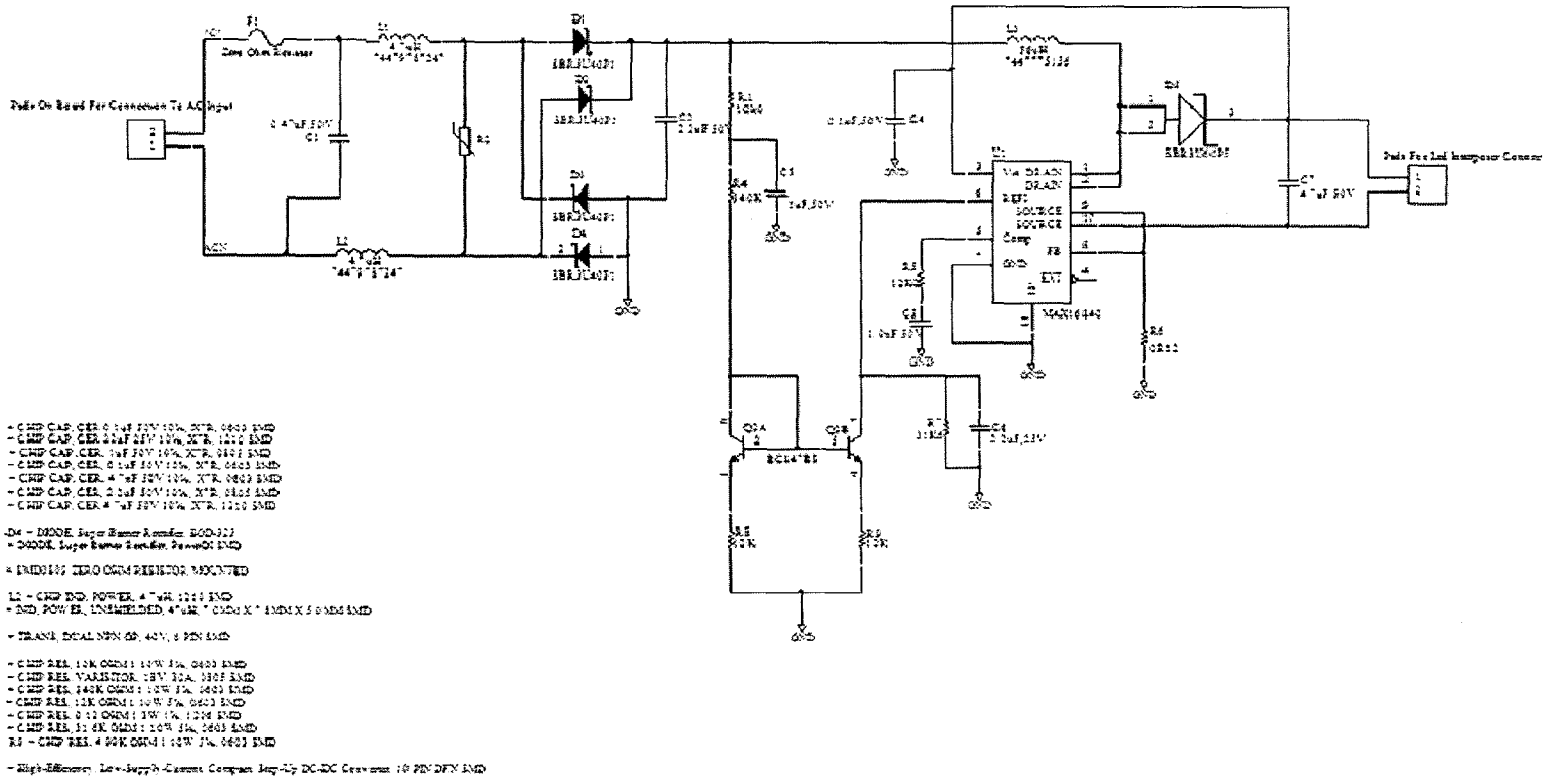

Electrical components 440 may be disposed upon circuit board 410 and/or upon FPC 430. The electrical components 440 includes circuitry that receives the operating voltage (e.g. 12 VAC) and converts it to an LED driving voltage (e.g. 40 VAC, 120 VAC, 180 VAC or the like). FIG. 4C illustrates an example circuit diagram providing this step-up voltage functionality. In various embodiments, components 440 include a Max 16814 LED driving circuit available from Maxim Integrated Products, Inc. In other examples, other driving circuitry may also be used.

In FIG. 4A, the output LED driving voltage is provided upon bonding pads (e.g. contacts) 450 of FPC 430. As will be illustrated further below, contacts 450 are coupled to bonding pads 360 of the LED module illustrated in FIGS. 3A-B, above.

FIG. 4A illustrates various embodiments of a base casing. In various embodiments, a base casing includes two separate portions 470 and 475 molded from an aluminum alloy. As was seen earlier in FIGS. 2A-B, the shape of the base casing is to be mated into an MR-16 format compatible heat sink. More specifically, the base casing is inserted into and fastened within an interior channel of the heat sink. This may be seen in a subsequent drawing.

LED driver circuit 400 is disposed between portions 470 and 475, and contacts 420 and contacts 450 remain outside. Portions 470 and 475 may be welded together, glued together or otherwise secured. In various embodiments, portions 470 and 475 may include one or more molded protrusions that extend towards LED circuitry 440, and may also be made of an aluminum alloy. The protrusions may be a series of pins, fins, or the like. Such protrusions may be provided as a way for heat to be conducted away from LED driver circuit 400 and towards the base casing. In various embodiments, the aluminum alloy is AL 1100, although other types and grades of aluminum may also be used, such as the aluminum alloy used for the heat sink.

The inventors believe that operating LED driving circuits at elevated temperatures for an MR-16 form factor light source has not been contemplated. In various embodiments of the invention, it is contemplated that electrical components 440 will be forced to operate at a high operating temperature, e.g. as high as 120° C., within the base casing. The source of the heat may include heat produced by electrical components 440, themselves, as well as heat generated by the LED module. In the latter case, the LED module would transfer heat to the base casing via the heat sink. In various embodiments, components of LED electrical circuitry 440 are selected for operation at these elevated temperatures (e.g. MILSPEC components). Additionally, to reduce the heat load upon electrical components 440, a potting compound, such as a thermally conductive silicone rubber (Epoxies.com 50-1225, Omegabond® available from Omega Engineering, Inc., or the like) may be injected or disposed within the interior of the base casing. In various embodiments, the potting compound is placed into physical contact with LED driver circuits 400 and the base casing, and it helps conduct heat generated by LED driver circuitry 400 outwards to the base casing. In various embodiments, the generated heat may be dissipated via the base casing and/or the heat sink.

As illustrated in FIG. 4B, the base sub assembly/module is thus assembled. In various embodiments, these base modules may then be individually tested for proper operation. In various embodiments, if the base module fails, it may be rejected, and if the base module passes, it may be used for the manufacturing process described below.

Figure 5A:
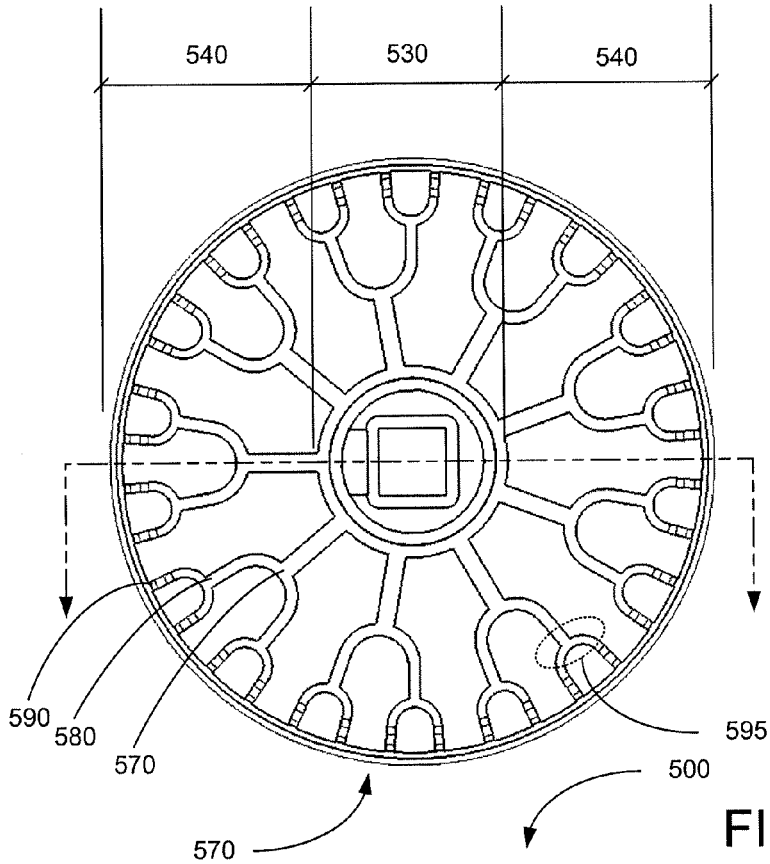
FIGS. 5A-B illustrate various embodiments of the present invention.
Figure 5B:
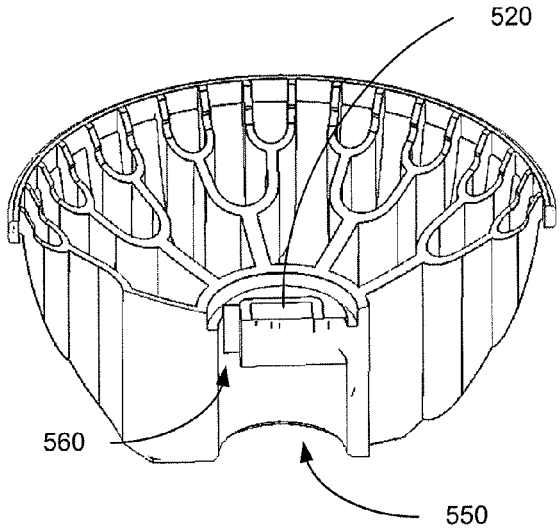

FIGS. 5A-B illustrate various embodiment of the present invention. More specifically, FIG. 5A-B illustrates various views of an embodiment of a heat sink 500 for an MR-16 compatible spot light.

In various embodiments, heat sink 500 and 510 are composed of an aluminum alloy that is thermally conductive, i.e. has low thermal resistance. In various embodiments, heat sinks 500 and 510 may be formed from a material having a low thermal resistance/high thermal conductivity. In some embodiments, heat sinks 500 and 510 may be formed from a black anodized 6061-T6 aluminum alloy having a thermal conductivity k=167 W/mk, and a thermal emissivity e=0.7. In other embodiments, other materials may be used such as 6063-T6 or 1050 aluminum alloy having a thermal conductivity k=225 W/mk and a thermal emissivity e=0.9. In other embodiments, still other alloys such AL 1100, or the like may be used. Additional coatings may also be added to increase thermal emissivity, for example, paint provided by ZYP Coatings, Inc. utilizing CR2O3 or CeO2 may provide a thermal emissivity e=0.9; coatings provided by Materials Technologies Corporation under the brand name Duracon™ may provide a thermal emissivity e>0.98; and the like.

In FIG. 5A, a relatively flat section 520 helps define an inner core region 530, and an outer core region 540. In various embodiments, by using LED modules described in the patent applications incorporated by reference herein, the brightness of the LED modules can match the brightness of conventional 50 watt halogen MR-16 lights, but only consume 20% of the power. As illustrated above, the LED modules can provide this brightness in a small form factor. In various embodiments, a LED module described above is bonded to flat section 520 of inner core 530, and outer core 540 helps dissipate the heat generated by the light module and by the base module. As described above, in some embodiments, no screws or other fasteners are used to secure the LED module to flat section 520. In some cases a thermal energy transferring epoxy, or the like may be used.

The inner core region 530, the light generating region is dramatically smaller than light generating regions of currently available MR-16 lights based upon LEDs. As illustrated in FIG. 5A, the diameter of inner core region 530 is less than one-third the diameter of outer core region 540. More specifically, it is approximately 30%. As a surprising result, heat fins 570 can dissipate a greater amount of heat than any other available MR-16 LED light. Having greater heat-dissipating surface area, it helps reduce the operating temperature of the LED driver circuitry, enables LED module to generate more heat (proportional to brightness), and the like.

In FIG. 5A, the top view of heat sink 500 illustrates configurations of heat sinks according to various embodiments of the present invention. As can be seen a series of nine branching heat fins 570 can be seen. In various embodiments, other numbers of heat fins 570 may be used, such as eight or ten, or seven or eleven, or the like.

In various embodiments, each heat fin 570 includes a trunk region and branches 580. Additionally, in some embodiments, branches 580 may include sub-branches 590. In still other embodiments, additional sub-sub-branches, or the like may also be included. In various embodiments, the ratios of the lengths of the trunk region, branches 580 and sub-branches 590 may be modified from the ratios illustrated.

The thickness of the heat fins decrease towards the outer edge of the heat sink, for example, the trunk region is thicker than branches 580 that are in turn thicker than sub-branches 590. In various embodiments, the ratios of the thicknesses of the trunk region, branches 580 and sub-branches 590 may be modified from the ratios illustrated.

Additionally, as can be seen in FIGS. 5A-B, when heat fins 570 branch, they branch off in a two to one ratio and in a "U" shape 595. When initially branching off, in some embodiments, the branches actually begin in a "T" shape, but as the branches extend outwards towards the rim, the branches take on the characteristic "U" shape. In various embodiments, the number of branches 580 extending from the trunk region, and the number of sub-branches 590 extending from and branches 580 may be modified from the number (two branches) illustrated.

The inventors believes that one of ordinary skill in the art would be able to simulate and design heat dissipation performance of heat sinks using the principles discussed herein. For example, embodiments of the present invention may have different numbers of branching heat fins 570 (e.g. 7, 8, 9, 10); different ratios of lengths of the trunks, branches, sub-branches, etc.; different number of branches; different thicknesses for the trunks, branches, sub-branches, etc.; different branch shapes; a different number of branches (e.g. 3, 4); a different number of branches for trunks, branches and sub-branches, or the like; a different branching pattern for different trunks; or the like. Accordingly, the specific configuration illustrated herein should not be limiting on the scope of embodiments of the present invention.

In FIG. 5B, a cross-section of heat sink 500 is illustrated including an interior channel 550. In various embodiments, interior channel 550 is adapted to receive the base module including the LED driver electronics, as described above. A narrower section 560 of interior channel 550 is also illustrated. In various embodiments, a thinner neck portion of the LED driver module, including LED driving voltage contacts, (e.g. bonding pads) shown in FIG. 4A, are inserted through narrower section 560, and locked into place by one or more lips or tabs on the LED driver module.

Figure 6A:
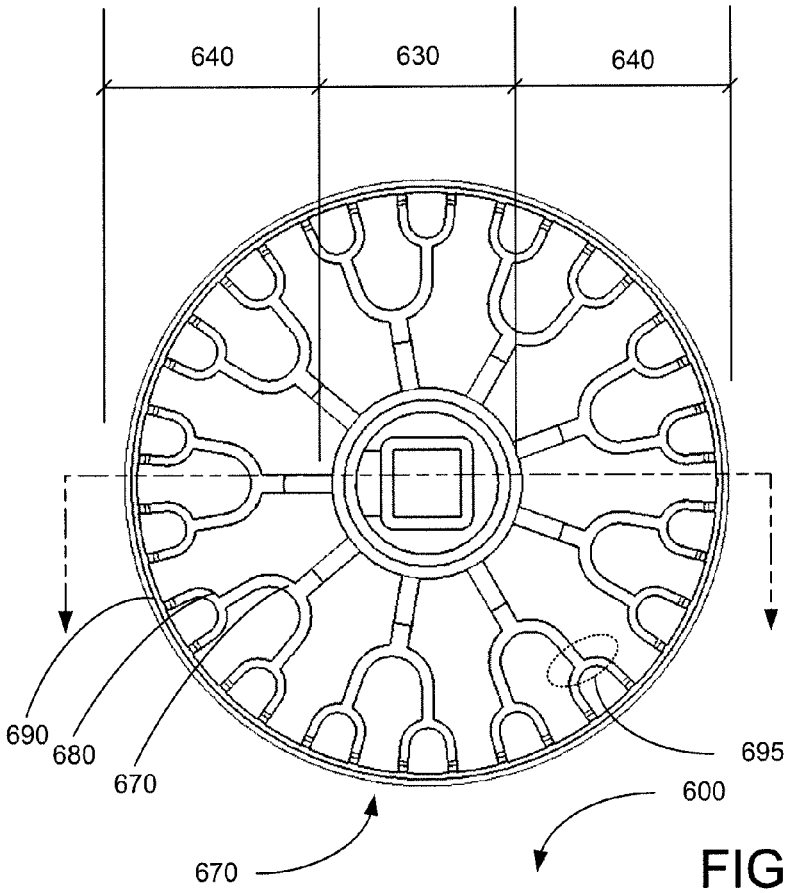
FIGS. 6A-B illustrate various embodiments of the present invention.
Figure 6B:
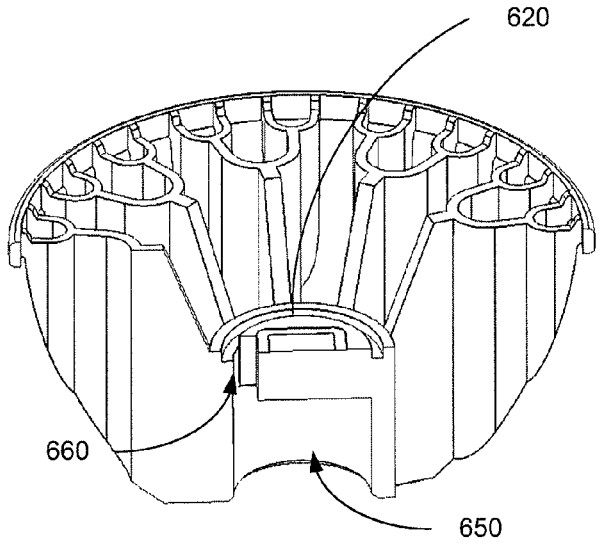

FIGS. 6A-B illustrate various embodiment of the present invention. More specifically, FIGS. 6A-B illustrates various views of an embodiment of a heat sink 600 for an MR-16 compatible flood light.

The discussion with respect to the spot-light embodiments in FIGS. 5A-B are applicable to the flood light embodiments illustrated in FIGS. 6A-B. For example, a heat sink 600 typically has a flat region 620 where a LED light module is bonded via a thermally conductive adhesive. Because the performance of LED light module is higher than any other module commercially available, LED light module can be made smaller, yet still provide the desired brightness. An inner core region 630 may thus be much smaller in diameter and an outer core region 640 may be much smaller than any other MR-16 LED light available. As a result, the heat dissipating capability of outer core region 640 is also higher than anything available.

Additionally, as discussed in FIGS. 5A-B, any number of heat dissipating fins 670 may be provided in heat sink 600. Heat dissipating fins 670 may also have branches 680 and sub-branches 690. As discussed above, in other embodiments of the present invention, the ratio of lengths of the trunks, branches 680, sub-branches 690 may be changed; the ratios of thicknesses of the trunks, branches 680, and sub-branches 690 may be changed; the number of branches from a trunk or sub-branches from a branch (e.g. 695) may be greater than two and not equal; the shapes of the branching may be changed; the branching logic of different trunks may be different, and the like. In light of the present patent disclosure, the inventors believe that one of ordinary skill in the art would be able to determine other obvious variations to the design of heat dissipating fins 670. Additionally, an interior channel 650 and 660 are also illustrated into which the base module/assembly is inserted.

Figure 7A:
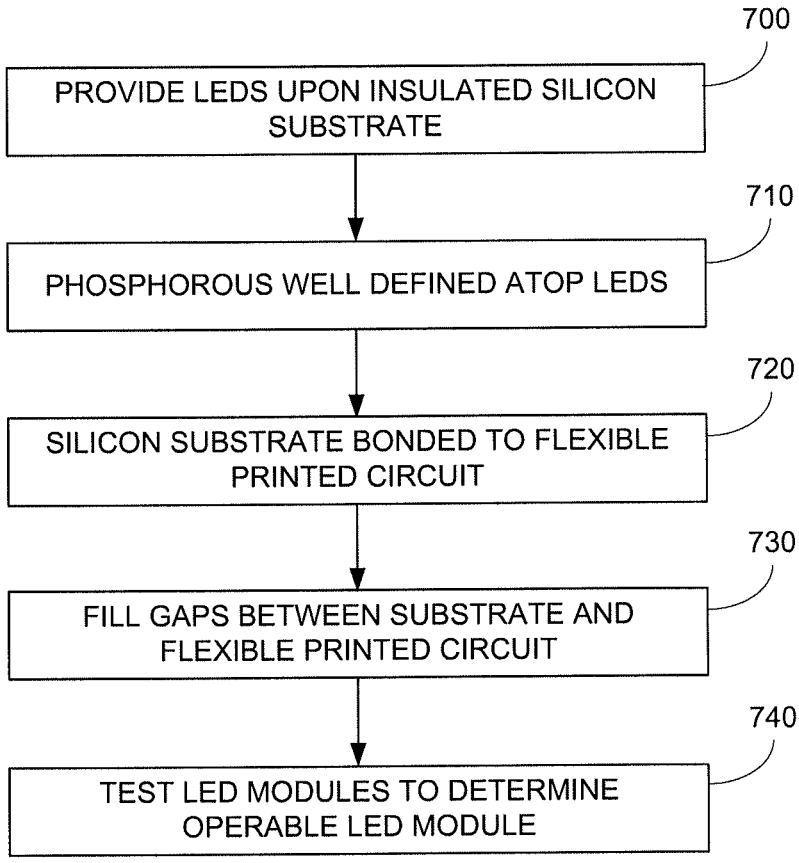
FIGS. 7A-C illustrate a block diagram of a manufacturing process according to embodiments of the present invention.
Figure 7B:
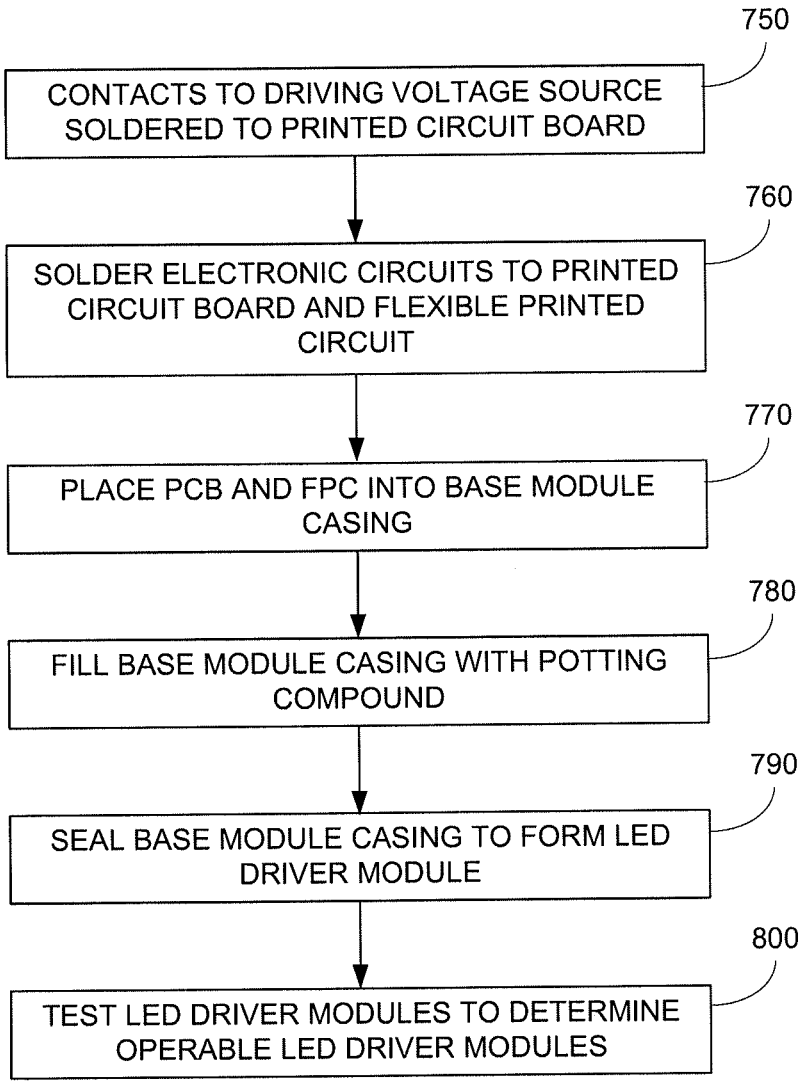
Figure 7C:
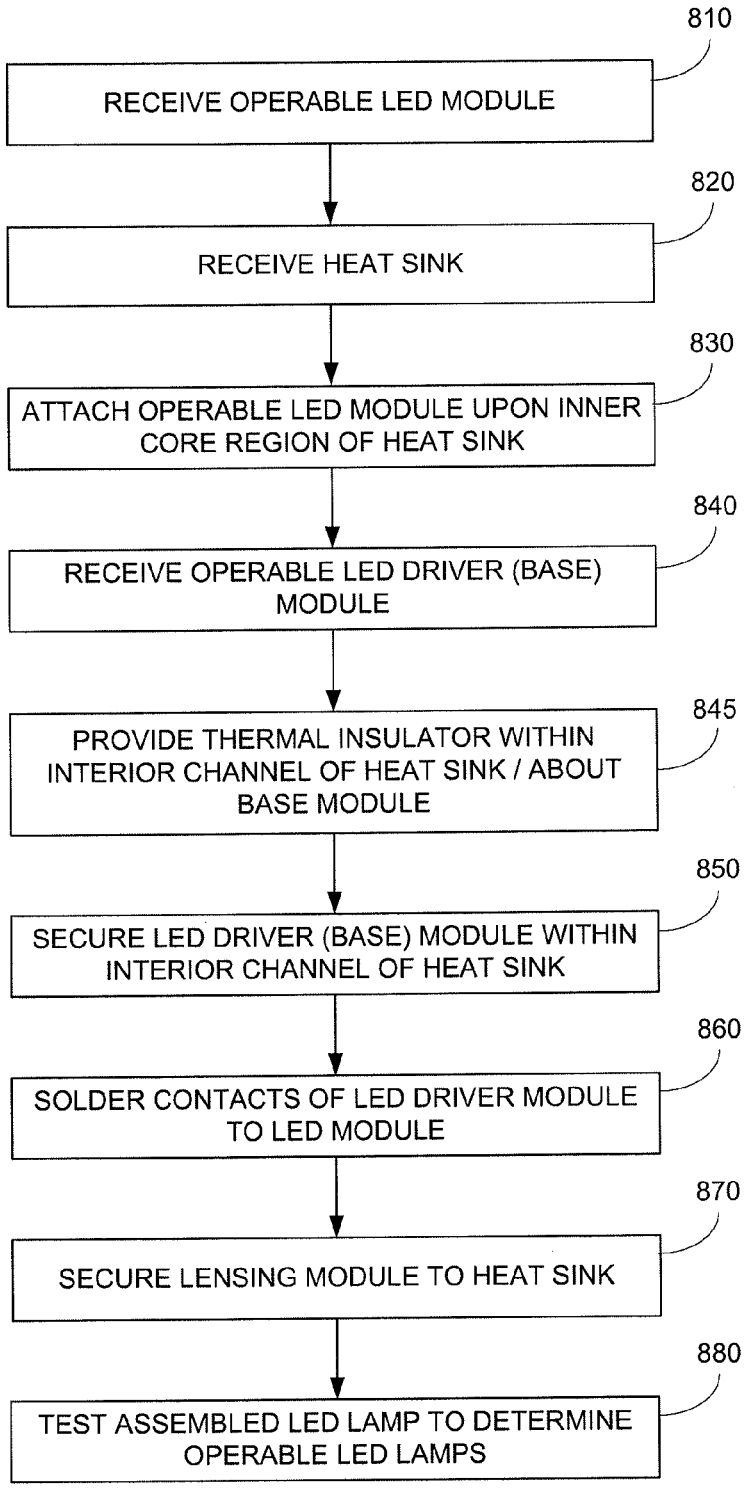

FIGS. 7A-C illustrate a block diagram of a manufacturing process according to embodiments of the present invention. In various embodiments, some of the manufacturing separate processes may occur in parallel or in series. For sake of understanding, reference may be given to features in prior figures.

The following process may be performed to form an LED assembly/module. Initially, a plurality of LEDs 300 are provided upon an electrically insulated silicon substrate 310 and wired, step 700. As illustrated in FIG. 3A, a silicone dam 315 is placed upon the silicon substrate 310 to define a well, which is then filled with a phosphor-bearing material, step 710. Next, the silicon substrate 310 is bonded to a flexible printed circuit 340, step 720. As disclosed above, a solder ball and flip-chip soldering (e.g. 330) may be used for the soldering process in various embodiments. Subsequently an under fill process may be performed to fill in gap 380, to form an LED assembly/module 340, step 730. In various embodiments, the LED assembly/module may then be tested for proper operation, step 740.

The following process may be performed to form a LED driver assembly/module. Initially, a plurality of contacts 420 may be soldered or coupled to a printed circuit board 410, step 750. These contacts 420 are for receiving a driving voltage of approximately 12 VAC. Next, a plurality of electronic circuit devices 440 (e.g. an LED driving integrated circuit) are soldered upon a flexible printed circuit 430 and upon a printed circuit board 410, step 760. As discussed above, unlike present state of the art MR-16 light bulbs, the electronic circuit devices 440, in various embodiments, are capable of sustained high-temperature operation, e.g. 120 degrees C. Subsequently the flexible printed circuit 430 and printed circuit board 410 are placed within two portions 470 and 475 of a base casing, step 770. As illustrated in FIGS. 4A-B, contacts 450 of flexible printed circuit 430 are exposed. Before sealing portions 470 and 475, a potting compound designed to transfer heat away from electronic circuit devices 440 and to the base casing, is injected or placed within the base casing, step 780. Subsequently two portions 470 and 475 are sealed, to form an LED driving assembly/module, step 790. In various embodiments, the LED driving assembly/module may then be tested for proper operation, step 800. In various embodiments, if the LED driving module fails, it may be rejected, and if the module passes, it may be used for the manufacturing process described below.

In FIG. 7C, a LED lamp assembly process is illustrated. Initially, a tested LED module is provided, step 810, and a heat sink (e.g. 500, 600) is provided, step 820. Next, in various embodiments, the LED module is attached to the heat sink, step 830. As discussed above, the LED module may be secured in an adjacent position via a thermally conductive epoxy, or the like.

A tested LED driver base module 295 is provided, step 840. In some embodiments, a thermal barrier is disposed into an interior cavity (e.g. 550, 560) of the heat sink (e.g. 500, 600), step 845. As discussed above, in various embodiments, the thermal barrier helps thermally isolate the heat sink from the LED driver base module. In particular, the thermal barrier reduces heat transfer from the LED light source or the heat sink to the LED driver base module. In other embodiments, a thermal barrier may be disposed upon an exterior surface (e.g. 245, 285) of a base module or assemblies, in this step.

Next, the tested LED driver module is inserted into an interior cavity (e.g. 550, 560) of the heat sink (e.g. 500, 600) with the thermal barrier layer substantially separating these components, step 850. In various embodiments, LED driver module/the thermal barrier layer may be secured to the heat sink via one or more physical tabs or lips on the LED driver module and/or the heat sink. Alternatively or additionally, an adhesive may be used to secure the heat sink, the LED driver module, and or the thermal barrier layer together.

The above operations places contacts 450 of LED driver (Base) module next/adjacent to contacts 360. Subsequently, a soldering step is performed to electrically connect contacts 450 to contacts 360, step 860. In some embodiments a hot bar soldering apparatus is used to solder contacts 450 to contacts 360. As illustrated in FIG. 7C, one or more lens modules may then be secured to the heat sink, step 870. As illustrated in the examples above, the lens module is dependent upon the type of light source that is desired, e.g. wide flood, narrow flood, spot, or the like. Subsequently, the assembled LED lamp may be tested to determine proper operation, step 880. In various embodiments, if the assembled LED lamp fails, one or more of the modules described above (e.g. base module, LED module may be easily swapped out, and a new tested module may be used. As can be seen, the modular embodiments described above can simplify the manufacturing process.

As can be seen, embodiments of the present invention enable and disclose a greatly simplified method for manufacturing an MR16 LED lamp. As illustrated in FIGS. 2A-2B, the number of major components used in various embodiments of the invention range from seven to eight components. In contrast, other currently available MR16 lamps may have from 14 to over 60 major components. Accordingly, the manufacturing process enabled by embodiments of the present invention are greatly simplified, and it is believed that the MR16 LED lamps that are manufactured will have a high level of reliability.

Figure 8A:
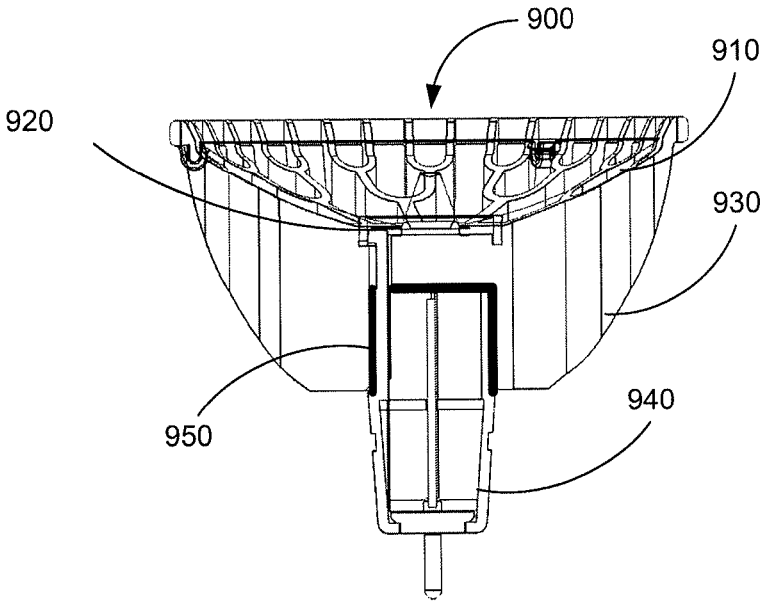
FIGS. 8A-B illustrate various embodiments of the present invention.
Figure 8B:
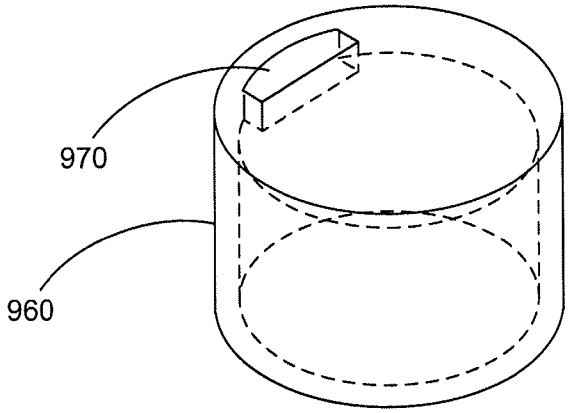

FIGS. 8A-B illustrate various embodiments of the present invention. In FIG. 8A, a cross-section of an embodiment of a MR-16 form factor compatible LED lighting source 900 is shown, having a GU 5.3 form factor compatible base, although other form factors are contemplated. In various embodiments, lighting source 900 includes a lens 910, an LED assembly/module 920, a heat sink 930, a base assembly/module 940, and a thermal barrier 950.

FIG. 8B illustrates a close-up view on a thermal barrier as an insulating sleeve 960. In various embodiments, insulating sleeve 960 may be manufactured using one or more materials such as silicone, rubber, plastics, ceramics, or the like. In various embodiments, insulating sleeve 960 may be pliable (e.g. silicone), hard (e.g. glass), or in between. As illustrated in FIG. 8B, insulating sleeve 960 may include an opening 970 that allow the base module to be physically and/or electrically coupled to the heat sink/LED module. In other embodiments, additional openings may be provided to allow the driver module to be physically secured to the heat sink.

Figure 9:
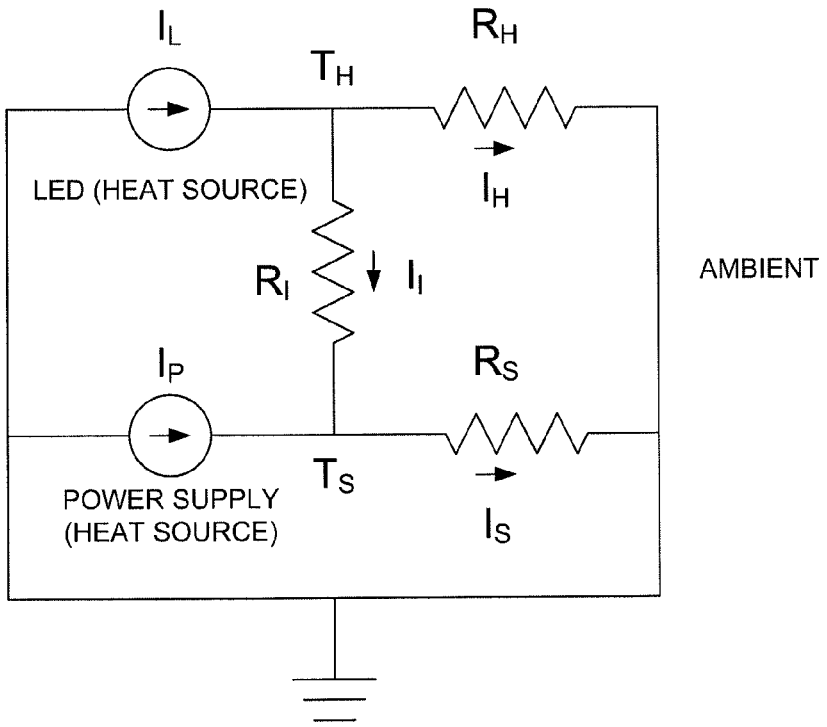
FIG. 9 illustrates various embodiments of the present invention.

FIG. 9 illustrates a diagram according to embodiments of the present invention. More particularly, the diagram represents a thermal load diagram. In FIG. 9, the sources of heat include the light emitting diodes (LEDs), IL, and the driver circuit (power supply), IP. As shown, the operating temperature of the LEDs is represented as TH and the operating temperature of the driver circuit is TS. Additionally, the thermal resistance between the heat sink to ambient is indicated as RH, and the thermal resistance between the base assembly to ambient is indicated as RS. The amount of heat transferred to ambient by the heat sink is indicated as IH, and the amount of heat transferred to ambient by the base assembly is indicated as IS. In various embodiments including a thermal insulating material/barrier, the thermal resistance is indicated as RI, and the amount of heat transferred from the base assembly to the heat sink is indicated by II.

In various embodiments, based upon the thermal model of FIG. 9, the following relationship is determined, where ΔTSH is the temperature difference between the LEDs and the base assembly:

$$\Delta TSH=((TH/RH)-IL)RI$$

In light of the above, so long as IL>IP, to increase ΔTSH, it is desirable to attempt to decrease the thermal resistance of the heat sink (RH), and to increase the thermal resistance of the thermal barrier (RI). In embodiments where IP>IL, a thermal barrier may not be desired.

In some examples, it is expected that IL is on the order of 8 W and IP is on the order of 1-2 W. Additionally, it is expected that RH is on the order of 8 C/W and RS is on the order of 30-40 C/W. In some experiments, RI can be on the order of 10-20 C/W, although in some embodiments it is desired that RI>>RS and RI>>RH.

Further embodiments can be envisioned to one of ordinary skill in the art after reading this disclosure. In other embodiments, combinations or sub-combinations of the above disclosed invention can be advantageously made. The block diagrams of the architecture and flow charts are grouped for ease of understanding. However it should be understood that combinations of blocks, additions of new blocks, re-arrangement of blocks, and the like are contemplated in alternative embodiments of the present invention.

The specification and drawings are, accordingly, to be regarded in an illustrative rather than a restrictive sense. It will, however, be evident that various modifications and changes may be made thereunto without departing from the broader spirit and scope.

What is claimed is:

1. An illumination source comprising:

an electronic power portion configured to provide an electrical power output in response to an external electrical power input, wherein the electronic power portion generates heat in response to the external electrical power input;

a light producing portion coupled to the electronic power portion and configured to output light energy in response to the electrical power output, wherein the light producing portion generates heat in response to the electrical power output;

a first heat dissipation portion physically coupled to the electronic power portion, wherein the first heat dissipation portion is configured to receive and dissipate heat from the electronic power portion;

a second heat dissipation portion physically coupled to the light producing portion and comprising an interior cavity, wherein the second heat dissipation portion is configured to receive and dissipate heat from the light producing portion; and a thermally insulating sleeve physically disposed within the interior cavity of the second heat dissipation portion, between the first heat dissipation portion and the second heat dissipation portion, wherein the first heat dissipation portion is disposed within the thermally insulating sleeve and the interior cavity of the second heat dissipation portion, and wherein the first heat dissipation portion is thermally isolated from the second heat dissipation portion.

2. The illumination source of claim 1 wherein the thermally insulating sleeve comprises a material selected from a group consisting of: silicone, rubber, plastic.

3. The illumination source of claim 1 wherein the thermally insulating sleeve comprises a material having a thermal conductivity of less than 2 watts/m*K.

4. The illumination source of claim 1 wherein the thermally insulating sleeve comprises a material having a thermal conductivity of less than 1 watts/m*K.

5. The illumination source of claim 1 wherein the electronic power portion is characterized by a first steady-state operating temperature;

wherein the light producing portion is characterized by a second steady state operating temperature; and wherein the first steady-state operating temperature is lower than the second steady state operating temperature.

6. The illumination source of claim 1 wherein the first heat dissipation portion is associated with a first thermal resistance;

wherein the second heat dissipation portion is associated with a second thermal resistance; and wherein the second thermal resistance is lower than the first thermal resistance.

7. The illumination source of claim 1 wherein the heat from the light producing portion is greater than the heat from the electronic power portion.

8. A method for assembling an illumination source, the method comprising:

providing an electronic power portion configured to provide an electrical power output in response to an external electrical power input, wherein the electronic power portion generates heat in response to the external electrical power input;

providing a first heat dissipation portion configured to receive and dissipate heat from the electronic power portion;

physically coupling the electronic power portion to the first heat dissipation portion to form a driving portion;

providing a light producing portion configured to output light energy in response to the electrical power output, wherein the light producing portion generates heat in response to the electrical power output;

providing a second heat dissipation portion comprising an interior cavity, wherein the second heat dissipation portion is configured to receive and dissipate heat from the light producing portion;

physically coupling the light producing portion to the second heat dissipation portion to form a lighting portion;

providing a thermally insulating sleeve;

physically disposing the thermally insulating sleeve within the interior cavity of the second heat dissipation portion; and physically coupling the driving portion to the lighting portion via the thermally insulating sleeve, wherein the first heat dissipation portion is disposed within the thermally insulating sleeve and the interior cavity of the second heat dissipation portion, and wherein the first heat dissipation portion is thermally isolated from the second heat dissipation portion.

9. The method of claim 8 wherein the thermally insulating sleeve comprises a material selected from a group consisting of: silicone, rubber, plastic.

10. The method of claim 8 wherein the thermally insulating sleeve comprises a material having a thermal conductivity of less than 2 watts/m*K.

11. The method of claim 8 wherein the thermally insulating sleeve comprises a material having a thermal conductivity of less than 1 watts/m*K.

12. The method of claim 8 wherein the electronic power portion is characterized by a first steady-state operating temperature;

wherein the light producing portion is characterized by a second steady state operating temperature; and wherein the first steady-state operating temperature is lower than the second steady state operating temperature.

13. The method of claim 8 wherein the first heat dissipation portion is associated with a first thermal resistance;

wherein the second heat dissipation portion is associated with a second thermal resistance; and wherein the second thermal resistance is lower than the first thermal resistance.

14. The method of claim 8 wherein the heat from the light producing portion is greater than the heat from the electronic power portion.

15. The illumination source of claim 5 wherein the first steady-state operating temperature is lower than the second steady state operating temperature by at least 5 degrees C.

16. The method of claim 12 wherein the first steady-state operating temperature is lower than the second steady state operating temperature by at least 5 degrees C.

17. The illumination source of claim 1, wherein the thermally insulating sleeve comprises an opening through which the light producing portion is electrically coupled to the electronic power portion.

18. The illumination source of claim 17, wherein the opening of the thermally insulating sleeve is inserted into a narrow section of the interior cavity.

19. The illumination source of claim 1, wherein:

the second heat dissipation portion comprises an inner core region and an outer core region;

the inner core region comprises a planar region;

the light producing portion is physically coupled to the planar region; and the outer core region comprises a plurality of fins configured to dissipate heat emanating from the inner core region.

20. The illumination source of claim 19, wherein:

each of the plurality of fins comprises a trunk and at least two branches;

one end of each trunk is coupled to the inner core region and the other end of each trunk is coupled to each of the at least two branches.

21. The illumination source of claim 20, wherein each of the at least two branches comprises at least two sub-branches.

22. The illumination source of claim 19, wherein the interior cavity of the second heat dissipation portion is bounded by the planar region and by the plurality of fins.

* * * * *